US005320089A

United States Patent [19]

Schaefer et al.

[11] Patent Number: 5,320,089

[45] Date of Patent: Jun. 14, 1994

[54] HEATABLE APPLIANCE FOR PERSONAL USE

[75] Inventors: Norbert Schaefer, Frankfurt am Main; Jiri Sobota, Kronberg/Ts.; Ahmet C. Firatli, Wiesbaden-Breckenheim; Friedrich Henninger, Kelkheim, all of Fed. Rep. of Germany

[73] Assignee: Braun Aktiengesellschaft, Fed. Rep. of Germany

[21] Appl. No.: 910,266

[22] PCT Filed: Dec. 13, 1990

[86] PCT No.: PCT/EP90/02176

§ 371 Date: Jul. 16, 1992

§ 102(e) Date: Jul. 16, 1992

[87] PCT Pub. No.: WO91/11128

PCT Pub. Date: Aug. 8, 1991

[30] Foreign Application Priority Data

Jan. 30, 1990 [DE] Fed. Rep. of Germany ..... 4002621

[51] Int. Cl.[5] ..... F23D 3/40

[52] U.S. Cl. ..... 126/409; 431/7; 431/329

[58] Field of Search ..... 431/268, 329, 328, 7, 431/147, 100, 350, 347, 354, 353; 126/413, 414, 92 AC, 401, 409

[56] References Cited

U.S. PATENT DOCUMENTS

| | | | |
|---|---|---|---|
| 3,204,683 | 9/1965 | Raff et al. | 431/347 X |
| 3,277,886 | 10/1966 | Ryals et al. | 431/329 X |
| 3,927,140 | 8/1976 | Placek | 431/329 |
| 4,248,208 | 2/1981 | Diederich | 126/409 |
| 4,361,133 | 11/1982 | Bonnema . | |
| 4,399,185 | 8/1983 | Petrow . | |
| 4,524,094 | 6/1985 | Lindstrom . | |
| 4,631,024 | 12/1986 | Shibata . | |
| 5,094,611 | 3/1992 | Suppiah et al. | 431/329 X |

FOREIGN PATENT DOCUMENTS

| | | |
|---|---|---|
| 0021224 | 6/1980 | European Pat. Off. . |
| 0082614 | 6/1983 | European Pat. Off. . |
| 0215253 | 3/1987 | European Pat. Off. . |
| 3617218 | 5/1986 | Fed. Rep. of Germany . |

OTHER PUBLICATIONS

Barrow, G. M., "Classifications of Adsorptions of Gases on Solids", Physical Chemistry, 1973, Sections 24-2 to 24-9, pp. 708-720.

*Primary Examiner*—Carl D. Price

*Attorney, Agent, or Firm*—Fish & Richardson

[57] ABSTRACT

The invention is directed to a heatable appliance for personal use, in particular a hair-care appliance, including a device for the flameless combustion of a fuel/air mixture and an associated activation device for initiating its flameless combustion, wherein the device includes a stable carrier structure 28 of a mass $m_T$ and a density $s_T$. The carrier structure 28 is provided with a coating having a specific surface area $O_B$ (according to the BET method) and a mass $m_B$, the coating carrying a catalytically active material of a mass $m_K$. In order to ensure a high mechanical stability, a satisfactory activation ability and at the same time a high resistance to poisoning of the catalyst, the ratio $$\text{delta} = \frac{O_B \times m_B}{m_T/s_T}\left[\frac{\text{cm}^2}{\text{cm}^3}\right]$$

is set at values in the following range:

$$0.3\times10^6 \leqq \text{delta} \leqq 30\times10^6.$$

15 Claims, 4 Drawing Sheets

HEATABLE APPLIANCE FOR PERSONAL USE

BACKGROUND OF THE INVENTION

This invention relates to a heatable appliance for personal use, in particular a hair-care appliance, including a device for the flameless combustion of a fuel/air mixture and an associated activation device for initiating its flameless combustion.

An appliance of this type is already known, for example, from U.S. Pat. No. 4,361,133. The device for flameless combustion is comprised of catalytically coated quartz wool which, for reasons of mechanical stability and a sufficiently accurate locating ability, is arranged between two spiral springs serving a supporting function for the quartz wool. The catalytically effective quartz wool serves for the flameless combustion of a fuel/air mixture supplied, the combustion heat being utilized for heating an appliance for personal use as, for example, for heating a gas-powered curling iron. However, the catalytic combustion action of the fuel/air mixture does not start until the catalytically active material has reached a specific activation temperature (LOT=light-off temperature). The energy required to obtain the activation temperature of the catalyst is supplied to the catalyst by means of an associated activation device. This activation device ignites a fuel/air mixture fed to a combustion chamber of the appliance after the fuel supply is started, the ignition being accomplished by means of one or several sparks or a flame introduced from outside, with the ignited fuel/air mixture becoming extinguished automatically within a fraction of one or several seconds. The energy released by this ignition is, however, sufficient to heat at least isolated zones of the catalyst to the activation temperature and to set off the catalytic, that is, the flameless combustion within the catalyst.

Whilst this appliance, sold in quantities in the million range in the past years, is well-established in practice, experience has shown that in single aspects the device for flameless combustion is still capable of improvement. First, the mechanical instability of the quartz wool and the resultant need to locate it in position by means of a mechanically stable supporting structure have given rise to problems. In the use of an appliance equipped with a catalyst of the type referred to above, it may happen that isolated fibers of the quartz wool fall out of their mechanical supporting structure which may adversely affect the passage of fuel by causing (partial) clogging of the fuel metering nozzle. Furthermore, loss of fiber may result in a deterioration of the activation action of the appliance, in particular where a piezoelectric igniter is used. Finally, the quartz wool is not in a position to ensure a consistent flow resistance at all times, so that hot spots may occur in partial areas of the catalyst. This impairs the service life of the catalyst materially.

On the other hand, it is precisely in the use of the known catalyst in hair-care appliances that the following problems occur: Specific user groups of such hair-care appliances heated by flameless combustion tend to apply hair-care products such as setting foams, hair spray, shampoo or the like prior to or while treating their hair. As a result, the air around the hair-care appliance is enriched with these hair-care substances or portions thereof to a greater or lesser degree. Some of this ambient air is aspirated by the fuel-heated hair-care appliance for producing a suitable fuel/air mixture. As comprehensive examinations have revealed, these hair-care products involve great disadvantages in respect of the useful life of the catalyst, particularly if they contain silicone-containing substances. If air enriched with hair-care agent is supplied to the catalyst for flameless combustion of the fuel, the tests performed and described in greater detail in the following reveal that a deposit of as little as 5 grams of hair-care agent accumulating on the catalyst is already sufficient to deteriorate the properties of the catalyst to a degree reducing the activation ability to intolerable values or to cause the degree of catalytic conversion of the fuel/air mixture to drop below a lower threshold. Therefore, appliances in which a deposit of more than 5 grams of hair-care agent accumulates on the catalyst are, as a rule, no longer usable, presenting a case for customer service.

SUMMARY OF THE INVENTION

In solving these problems, it is to be considered that suggestions from the field of catalytic exhaust-gas cleaning in automotive vehicles where, among others, catalysts having a stable supporting structure are used, are not readily applicable to the present field. While exhaust-gas catalysts are likewise susceptible to poisoning, particularly by leaded substances, the poisoning phenomenon occurring in the present catalyst is, however, of an entirely different nature. The aim is to provide suitable means for making the catalyst resistant to these poisoning substances. The catalyst described herein is used for the generation of heat, from which the following requirements differing from those of exhaust-gas catalysts result. First, the geometrical configuration of the catalyst is determined by an emission of heat as effective as possible to the heating surface. Furthermore, and this is a difference carrying considerable weight, the present catalyst is required to be brought to its activation temperature by an ignition explosion or a temporary flame, whereas the exhaust-gas catalyst attains the necessary operating temperature without further means automatically as a result of the hot exhaust gases flowing past it. The development of an improved catalyst overcoming the disadvantages set forth is significantly determined by the boundary condition to bring the catalyst to its activation temperature initially by a temporary combustion of the fuel/air mixture using an open flame or an explosion-type ignition of the mixture.

It is an object of the present invention to improve upon a heatable appliance for personal use having a device for the flameless combustion of a fuel/air mixture and an associated activation device for initiating the flameless combustion, to the effect that the useful life of the appliance is considerably prolonged. This object is accomplished in that the device includes a stable carrier structure of a mass $m_T$ and a density $s_T$, with the carrier structure being provided with a coating having a specific surface area $O_B$ (measured according to the BET method) and a mass $m_B$, the coating carrying or containing a catalytically active material of a mass $m_K$, and the ratio $$\text{delta} = \frac{O_B \times m_B}{m_T/s_T} \quad \frac{\text{cm}^2}{\text{cm}^3}$$

assuming values in the range of $$0.3 \times 10^6 \lesssim \text{delta} \lesssim 30 \times 10^6.$$

The BET method is a well-known technique for measuring the surface area of a complex surface by employing an adsorption isotherm that follows from a theory developed by Brunauer, Emmett, and Teller (i.e., the BET isotherm).

This presentation of parameters using the quantity delta—delta being the effective surface area (measured according to the BET method) of the coating of the catalyst in relation to the volume of the carrier structure—was selected for the following reasons: As examinations suggest, the effective surface area of the coating of a catalyst serving as the carrier of the catalytically active material is determining for the maximum permissible deposit of hair-care agents or similar poisoning substances on the catalyst. The larger the selected surface area of the coating, the less sensitive the catalyst is to a deposit of such substances. Considering this effect alone, the surface area of the coating is therefore suitably designed to maximum values. For a predetermined specific value of the surface area of the respective coating material employed, the surface area per catalyst can only be increased by increasing the mass of the coating. On the other hand, an upper limit is reached if allowance is also made for the activation ability of the catalyst by means of a temporary supply of heat by an open flame or an ignition explosion. An increase in the mass of the coating material results in an increase in the thermal capacity of the catalyst and an ensuing deterioration of the activating behavior. For activating the catalyst, only a limited supply of fuel/air mixture is available, because the dimensions of the ignitable volume are restricted, being governed by the type of appliance involved. If the fuel/air mixture to be ignited by a spark is limited in its volume, the catalyst is unable to exceed specific values with regard to the permissible thermal capacity if reliable activation is to be ensured. In view of such constraints, the maximum permissible surface area of the coating of the catalyst is limited to upper values.

The denominator of the quantity delta is formed by the volume of the carrier structure. A large volume of the carrier structure results in a large mass of the carrier structure and thus in a high thermal capacity of the catalyst. Therefore, the mass should assume low values so as not to impair the activation ability of the catalyst. On the other hand, the mass or the volume of the carrier structure also determines its mechanical stability. The mechanical stability of the carrier structure decreases with the mass or the volume of the carrier structure.

Accordingly, the effects of contradicting requirements may be represented by means of the quantity delta. The mechanical stability of the catalyst necessitates a high mass or a large volume of the carrier structure. To describe the effects and determine the limit values, the volume of the carrier structure is preferred over other possible quantities as mass or thermal capacity, because a property independent of the material and affording ease of verification enters into the quantity delta as a parameter. From the physical point of view, it would appear more appropriate to use the thermal capacity which, however, is directly proportional to the volume of the carrier, with the carrier material predetermined. A large surface area or large mass of the coating ensures insensitivity to a deposit of hair-care agent. On the other hand, a large mass of coating or of the carrier structure results in an increase in the thermal capacity of the catalyst and a deterioration of the activation ability. As examinations have revealed, sufficient allowance is made for the three prerequisites, which include sufficient mechanical stability, increased insensitivity to deposits and a good activation ability, if delta assumes values in the range of between $0.3\times10^6$ and $30\times10^6$ $cm^2/cm^3$. The activation ability is good as compared with that of conventional appliances, the sensitivity to a deposit of hair-care agent is reduced by more than a factor 10, and the mechanical stability is improved by a multiple, enabling the catalyst to be installed in the appliance as a self-contained assembly, manufactured to geometrical precision and so as to obtain repeatability characteristics. Mechanical problems due to fibers falling out of the catalyst are eliminated. Owing to the sufficient mechanical stability, the catalyst can be manufactured to geometrically defined dimensions combined with a defined adjustment of the flow resistance. For the same reasons, the flow resistance may be considered constant and adjusted so as to be repeatable over the life of the catalyst. In addition to the increased resistance to poisoning occurring, for example, due to the deposit of hair-care agent, a reclamation of the catalytically active material applied to the coating can be accomplished with considerably greater ease. Furthermore, the mechanically stable catalytic device affords significant advantages in the manufacture of the appliances and in the event of necessary repairs by service centers. Finally, the shapeability of the carrier structure while yet providing mechanical stability affords an ample range of geometrical configurations. Thus, aside from hollow cylindrical structures, also prismatic or oval or undulate structures may be manufactured readily.

Because the carrier structure is comprised of a perforated metal foil, in particular a stainless-steel foil or, alternatively, a wire lattice of a thickness of less than 100 micrometers and preferably about 35 micrometers, a carrier structure of low volume, while yet providing sufficient mechanical stability, is advantageously obtained ensuring reliable activation of the catalyst. By specifying the percentage of perforations to a range of between 5% and 60%, preferably between 15% and 50%, of the total area of the carrier structure, a particularly low flow resistance adjustable to defined values results for the catalyst carrier, while the mechanical stability inherent to an imperforate carrier foil is largely maintained. Specifying the specific surface area of the ceramic coating $O_B$ to values greater than or about equal to 100 $m^2/g$, in particular to extremely advantageous surface area values $O_B$ of 200 $m^2/g$, approximately, has proven to be especially useful and successful because this enables a large surface area of the coating to be accomplished while the mass of the coating is relatively low. While measurements of the specific surface area of the known catalytic coating have shown to amount to about 20 $m^2/g$, the specific surface area of the coating of the present invention is about ten times higher. Coatings of such a large specific surface area are generally used in the manufacture of catalysts as carriers of the catalytically active material in order to provide the precondition for a large catalytically active area in a confined space. Thus, the conventional catalysts employed in gas-powered curling irons have a coating with a surface area of about 0.6 $m^2$ (according to the BET method) with a catalytically active area of about 0.1 to 0.3 $m^2$ (measured on the basis of the amount of CO that is deposited on the surface). Although the CO surface area (that is, measured on the basis of CO deposit) decisive for the catalytic activity has sufficiently large dimensions with regard to the amount of gas to be burned catalytically, it is nevertheless appropriate to increase the surface area of the coating as much as possible, with due consideration of the further boundary conditions. As examinations and experiments have revealed, the susceptibility of the catalyst to poisoning by hair-care agents, particularly by the silicone-containing substances contained in these hair-care agents, is thereby reduced significantly. A possible explanation for this effect may be that the particles responsible for poisoning of the catalyst accumulate statistically on the surface of the ceramic coating, independent of whether or not the ceramic coating carries a catalytically active material. If only a specific fraction of the ceramic coating is provided with a catalytically active material, the substances causing catalyst poisoning can contribute to the poisoning in an amount corresponding to this particular fraction only, assuming that the deposit on the catalyst accumulates in a statistically uniformly distributed fashion.

Because the ratio of the mass of the catalytically active material to the mass of the coating assumes values smaller than 0.2 and preferably values smaller than 0.13, sintering of the catalytically active material involving a reduction in the catalytically active surface area (CO surface area) is avoided to the largest possible extent. With this setting, the mean cluster spacing, for example, the platinum cluster, amounts to a multiple of the average diameter of a cluster, so that intermolecular interactions producing sintering of the catalytically active material are largely negligible at the prevailing operating temperatures of the catalyst. In addition, by so setting the relationship between the mass of catalytically active material and the mass of the coating, allowance is made for the fact that only a fraction of the surface area of the coating has to be coated with catalytically active material.

Because the activation device ignites a fuel/air mixture of a volume $V_G$, and because the overall mass $m_G$ of the catalyst, related to the volume $V_G$, assumes values smaller than 0.1 g/cm$^3$ and preferably values smaller than 0.01 g/cm$^3$, an extremely advantageous rating rule independent of the catalyst structure per se is provided to ensure a highly advantageous activating behavior of the catalyst. This rating rule makes allowance for the fact that the catalyst, at a predetermined value of the ignitable volume, may be brought to its operating temperature by ignition of this volume the earlier, the lower the overall mass of the catalyst. On the basis of experimental examinations, it could be assessed that an ignitable volume of 1 cm$^3$ is in a position to heat a catalytic mass of up to 100 mg to operating temperature. Preferred values lie in the range of below 10 mg up to 30 mg of catalytic mass per cm$^3$ of ignitable volume. A lower limit in respect of the catalytic mass is provided by the boundary condition that the catalyst have a mechanically stable behavior. Setting the relationship between the mass of the coating and the mass of the carrier structure at values in the range of between 0.02 and 0.60, preferably at values of the order of 0.20+/−50%, provides an optimum for the catalyst in respect of the two prerequisites mechanical stability and insusceptibility to the effects of poisoning. Especially for a carrier structure comprising a stainless-steel foil of a thickness d of about 35 micrometers+/−25% and with a ceramic coating as, for example, metastable alumina having a specific surface area of about 200 m$^2$/g (according to the BET method), the parameter delta is set at values in the range of $2.8\times10^6$+/−50% cm$^2$/cm$^3$. Although the special range of values of the parameter delta is also dependent on the geometrical configuration of the catalyst, this range has proven to be highly successful for the application of the catalyst in a gas-powered curling iron. For one thing, the catalyst is mechanically stable and capable of activation, and for another thing, it is highly insusceptible to the deposit of hair-care agent. By arranging at least 2.5% of the area of the carrier structure normal to a direction of propagation of a flame front produced by the activation device, a rating rule for the arrangement of the catalyst in an appliance for personal use is provided which ensures a particularly high activation ability of the catalyst. This value represents a lower limit. In a special geometrical arrangement, this percentage of the carrier structure area may well assume values in the range of between 5 and 15%, resulting in extremely favorable activation properties. The use of a distributor made of a screen fabric and arranged upstream of the catalyst when viewed in the direction of flow homogenizes the fuel/air mixture still further, thus effecting a highly uniform combustion in the catalyst.

A particularly advantageous catalyst for use in gas-powered curling irons is provided by the use of a stainless-steel foil with a thickness of between 25 micrometers and 50 micrometers as the carrier structure, wherein the percentage of perforations related to the total area is between 15% and 50%, by applying a ceramic coating to the stainless-steel foil with a specific surface area (according to the BET method) of about 200 m$^2$/g, and by setting the ratio of the coating mass to the carrier foil mass at values of the order of about 0.2+/−50%. The dimensioning of the catalyst represents an optimum between the different boundary conditions, that is, activation ability, insusceptibility to poisoning, and mechanical stability. In practice, a ratio of the platinum mass to the mass of the coating of 0.1+/−50% has proved to be an extremely advantageous compromise ensuring a high activation ability for one thing and a high poisoning resistance for another thing. The special geometrical configuration of the stainless-steel foil as a hollow cylinder closed at one end and having a height of about 3 cm and a mean diameter of about 1 cm makes the catalyst optimally adapted for use in a gas-powered curling iron. The catalyst finds particularly advantageous application in gas-powered curling irons, hair dryers, smoothing irons, curler stations, bottle warmers, gas cookers, warming plates, and the like.

BRIEF DESCRIPTION OF THE DRAWINGS

Further advantages will become apparent from the subsequent description in combination with the accompanying drawings.

In the drawings.

DESCRIPTION OF THE PREFERRED EMBODIMENTS

Figure 1:
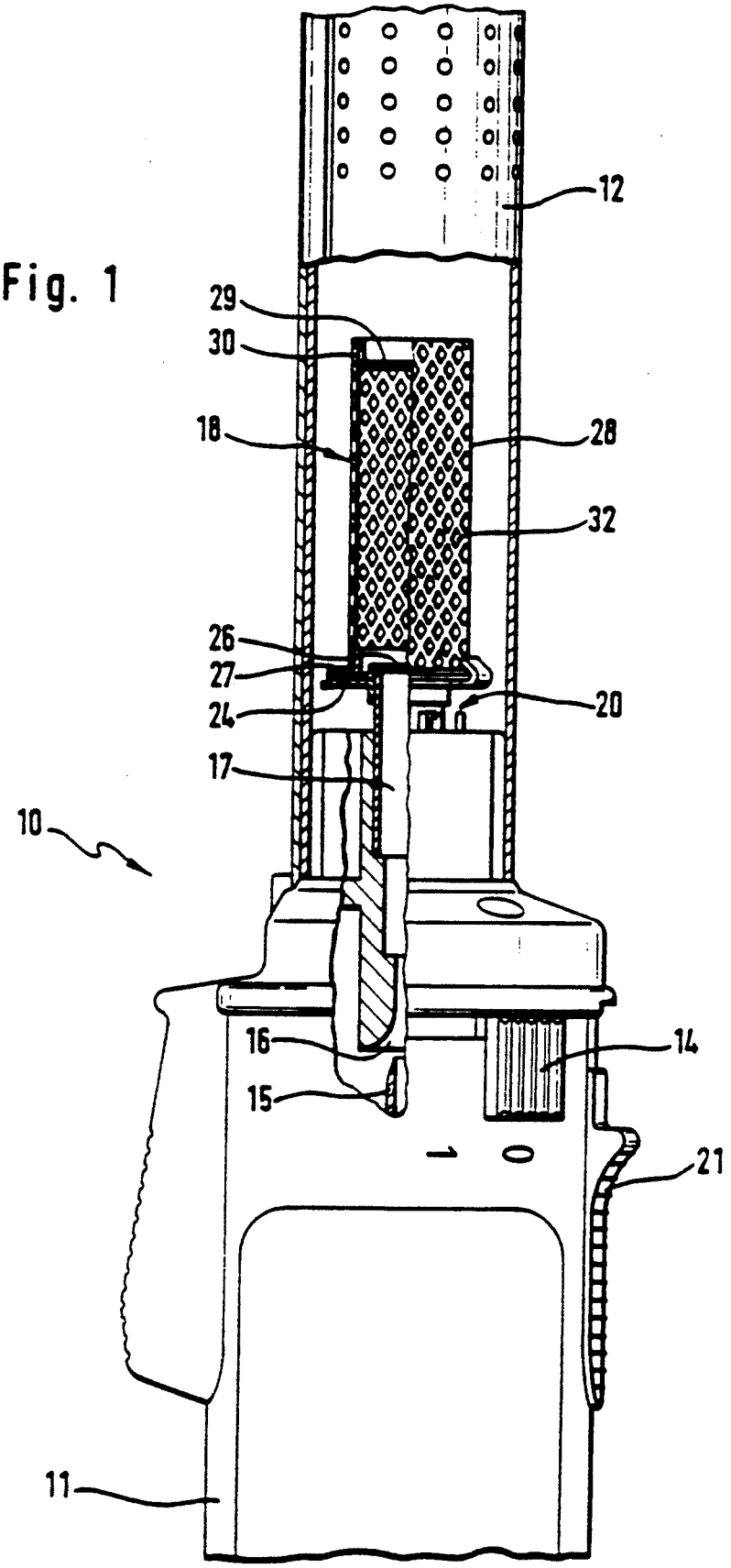
FIG. 1 is a side view of a section of a gas-powered curling iron, shown partly broken away.

Referring now to FIG. 1 of the drawings, there is shown a fragmentary view of a curling iron 10 with a hair winding portion 12 partly broken away and a handle 11. A nozzle 15 for operation of the curling iron is opened by means of a switch 14. Gas held in a container not shown which is received in the handle 11 flows through the nozzle 15 into a Venturi tube 16. In this area, the fuel discharged from the nozzle 15 mixes intimately with the ambient air supplied or aspirated from outside. Adjoining the Venturi tube 16 is a tube 17 supplying the fuel/air mixture to a catalytic device 18 arranged concentrically in the interior of the hair winding portion 12. Ignition electrodes 20 are disposed between the Venturi tube 16 and the catalytic device 18. The ignition electrodes 20 serve the function of producing one or several sparks for igniting the fuel/air mixture inside the hair winding portion 12. The ignition electrodes 20 are actuated by means of a slide switch 21 provided on the handle 11 and operating on a piezoelectric element. With the catalytic device 18 suitably dimensioned, the energy released by combustion of the fuel/air mixture contained in the hair winding portion 12 is sufficient to heat the catalytic device to an operating temperature, that is, to activate it, in order to thus set off the flameless combustion of the fuel/air mixture by means of the catalytic device 18. The initial ignition explosion of the fuel/air mixture ignited by the ignition electrodes 20 becomes extinguished within fractions of a second by the blast wave in the space in the interior of the hair winding portion 12, which space is essentially closed on all sides, causing the catalytic combustion of the fuel/air mixture to be initiated automatically without the need for further manipulation on the appliance. In lieu of using ignition electrodes 20 for ignition, a friction wheel igniter, a helical heating wire with battery or an open flame supplied from outside may be used with equal advantage.

Figure 2:
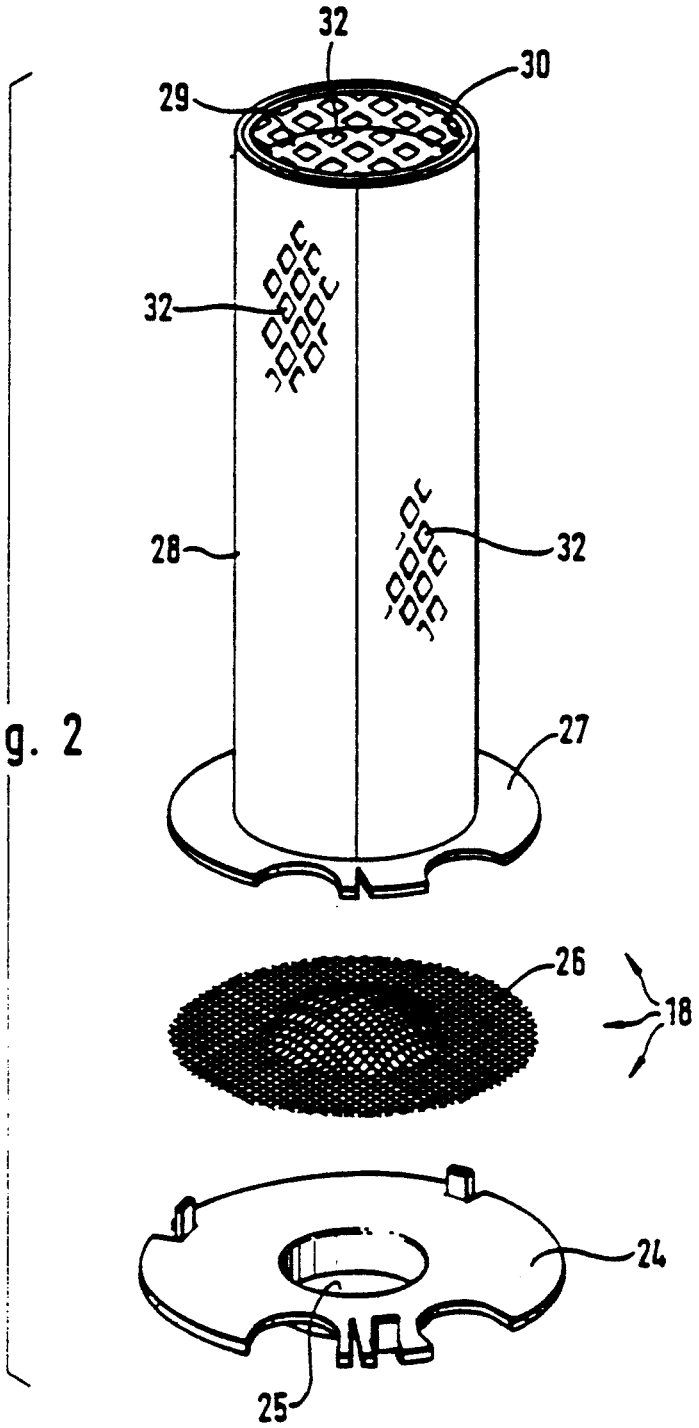
FIG. 2 is an exploded view of the catalytic device.

As becomes apparent from FIG. 1 and more clearly from FIG. 2, the catalytic device 18 is comprised of a mounting plate 24 adjoining the tube 17 and having a central aperture 25. Arranged between this mounting plate 24 and a supporting ring 27 is a distributor 26 made of a screen fabric with a mesh size in the range of between 50 micrometers and 500 micrometers, particularly 180 micrometers, approximately. The distributor 26 serves the function of producing a uniform flow pattern of the fuel/air mixture within the catalytic device 18 and ensures an even, homogeneous combustion. The supporting ring 27 holds a carrier structure 28 closed at one end and configured as a hollow cylinder. At its upper end, the carrier structure 28 has a lid 29 secured thereto so as to be somewhat recessed in the interior of the hollow cylinder and closing the hollow cylinder in downstream direction by forming an annular wall 30. The lid 29 may be provided with perforations 32 or, optionally, may be imperforate. The special configuration of the lid 29 is determined by the boundary condition to accomplish an optimum activating behavior of the catalyst. Experience has shown that a lid 29 having no perforations 32 is liable to contribute to a particularly good activating behavior, depending on the special geometry. The carrier structure 28 is made of steel foil of a thickness of less than 100 micrometers, preferably a thickness of between 25 micrometers and 50 micrometers, in particular 35 micrometers (manufacturer: Sandvik, Sweden, Material OC 404). The steel foil, that is, the carrier structure 28 has perforations 32 the maximum diameter of which should not be substantially greater than 2 mm. The percentage of uniformly arranged perforations 32, related to a projected area parallel to the carrier structure 28, should be in the range of between 5% and 60%, preferably between 15% and 50%, in particular of the order of 42% to 43%, approximately. In the present embodiment, the carrier structure 28 has a height of about 30 mm, a diameter of about 10 mm and a mass of about 140 mg. The supporting ring 27 fixedly connected with the carrier structure 28 has a mass of about 0.2 g+/−20%, which mass should be taken into consideration with a view to the activation quality of the catalyst, avoiding the selection of an unnecessarily large mass. With regard to the catalytic properties of the catalyst, the mass of the carrier structure 28 is less decisive. The perforations in the carrier structure 28 may be produced by etching or stamping the metal foil. For manufacturing reasons, however, an expanded-metal lattice is preferred. It will be appreciated that the invention is not limited to the details shown and that various modifications may be made to the carrier structure 28 by manufacturing it from wound or woven wire without departing from the spirit and scope of the invention.

Figure 3:
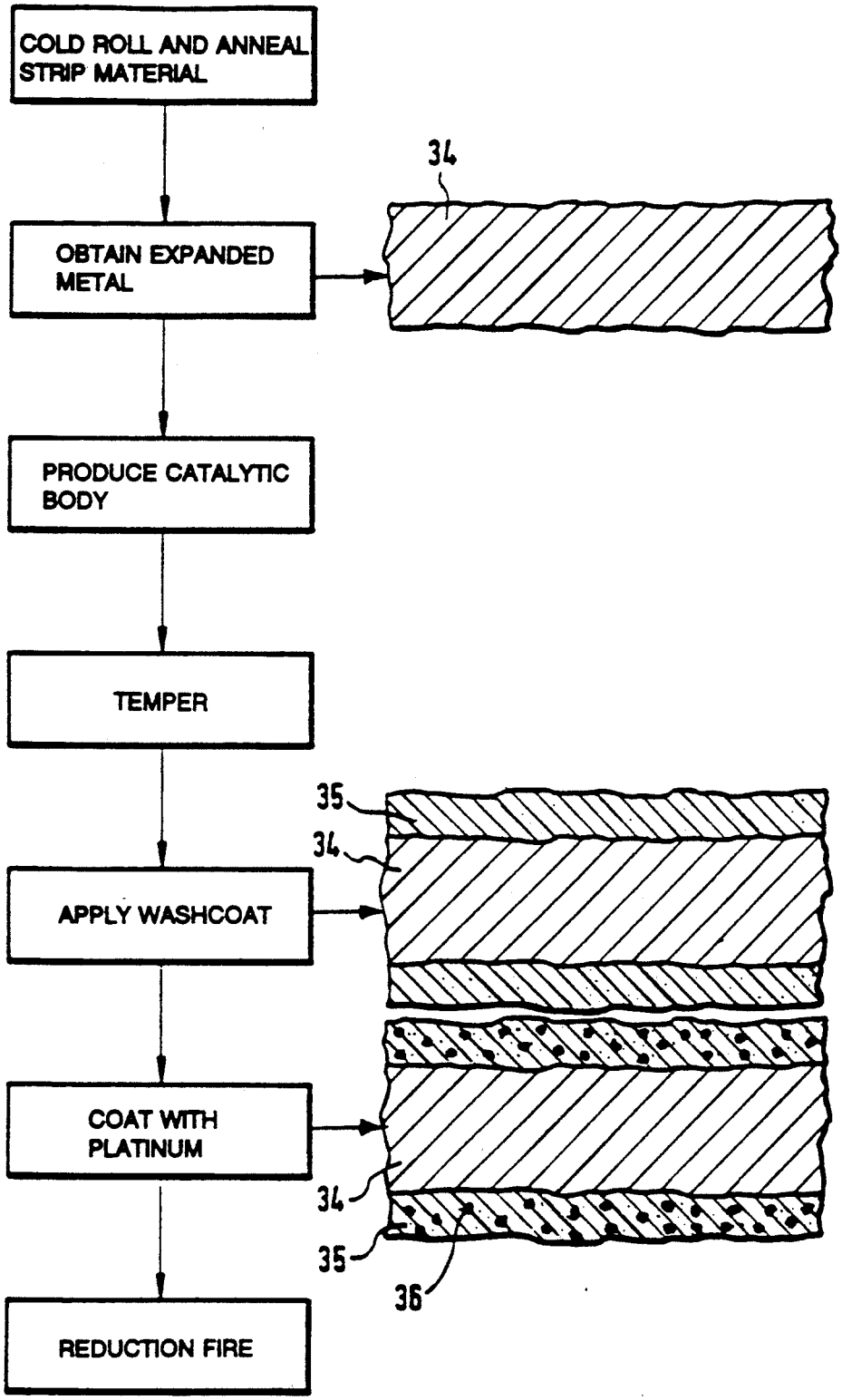
FIG. 3 is a flow chart to explain the method of manufacturing the catalyst.

As shown in FIG. 3, an expanded-metal foil 34 is produced from the metal foil by slotting and expanding it. In a subsequent step, the hollow-cylindrical carrier structure 28 closed at one end is produced from the expanded-metal foil 34. Following cleaning and heat treatment of the carrier structure 28 for nucleation and controlled oxidation (tempering), a ceramic coating 35 (washcoat), in particular metastable alumina, for example, gamma $Al_2O_3$, is applied thereto. With the carrier structure 28 having a mass of about 140 mg, the mass of this coating 35 is about 26+/−5 mg in a preferred embodiment. The specific surface area of the ceramic coating 35 is preferably greater than 100 $m^2/g$, particularly about 200 $m^2/g$ (according to the BET method). Then a catalytically active material 36 is adhered to the ceramic coating 35, with platinum or palladium or rhodium being preferred. In the present embodiment, a platinum mass of about 5 mg is applied to the catalyst. It is to be noted, however, that this value represents an upper limit, dictated by manufacturing reasons, for the platinum mass to be applied, with a platinum mass of as little as 2 to 3 mg per catalyst being already sufficient. The last step involves reduction firing of the catalyst for activating the catalytically active material 36 for the first time. As an option, the ceramic coating 35 and the catalytically active material 36, particularly platinum, may be applied to the carrier structure 28 in a single operation.

The catalytic device 18 manufactured in this manner is then installed in the hair winding portion 12 of the curling iron 10. The catalytic device 18 is operated at flow rates of an isobutane gas of between 60 and 120 mg per minute and a fuel/air ratio of between 1 to 20 and 1 to 35. The catalytic device is activated, that is, heated to temperatures at which the catalytic activity is sufficient to burn the fuel/air mixture supplied, by piezoelectric ignition of the fuel/air mixture present in the chamber in the interior of the hair winding portion 12 by means of the ignition electrodes 20. In the preferred embodiment, a fuel/air mixture with a volume of about 24 $cm^3$ is sufficient to reliably activate the catalyst with its overall mass of about 360 mg to 380 mg. This mass of between 360 mg and 380 mg includes not only the mass $m_T$ of the carrier structure 28, but also the mass of the supporting ring 27 which must also be considered in the examination of the activation quality on account of its good thermal coupling. The overall mass comprising carrier structure 28 and supporting ring 27 is identified by $m_T$. The activation temperature (LOT) is of the order of about 120° C. For reliable activation, part of the carrier structure 28 of the catalytic device 18 is suitably arranged normal to the propagation direction of the blast wave of the fuel/air mixture. In practice, a value of at least 2.5% of the overall surface area of the carrier structure 28 has proved to be sufficient. Excellent results are obtained with a surface area of the carrier structure 28 normal to the propagation direction of the ignition explosion of about 5% to 15%. For an optimum activation ability, also the formation of the annular wall 30 (FIGS. 1, 2) at the downstream end of the carrier structure 28 appears to be of importance. A possible explanation for this phenomenon is that this annular wall 30 contributes to the formation of turbulence during the explosion of the fuel/air mixture. As a rule, first the center of the lid 29 is heated to operating temperature, thus becoming catalytically active. In this respect, it is suitable to optimize in particular the lid 29 with regard to its activation ability. Within a few seconds, the entire catalytic device 18 will then be heated to an operating temperature in the range of about 400° C. up to about 900° C. due to internal heat conduction, thus contributing as a whole to the flameless combustion of the fuel/air mixture.

Figure 4:
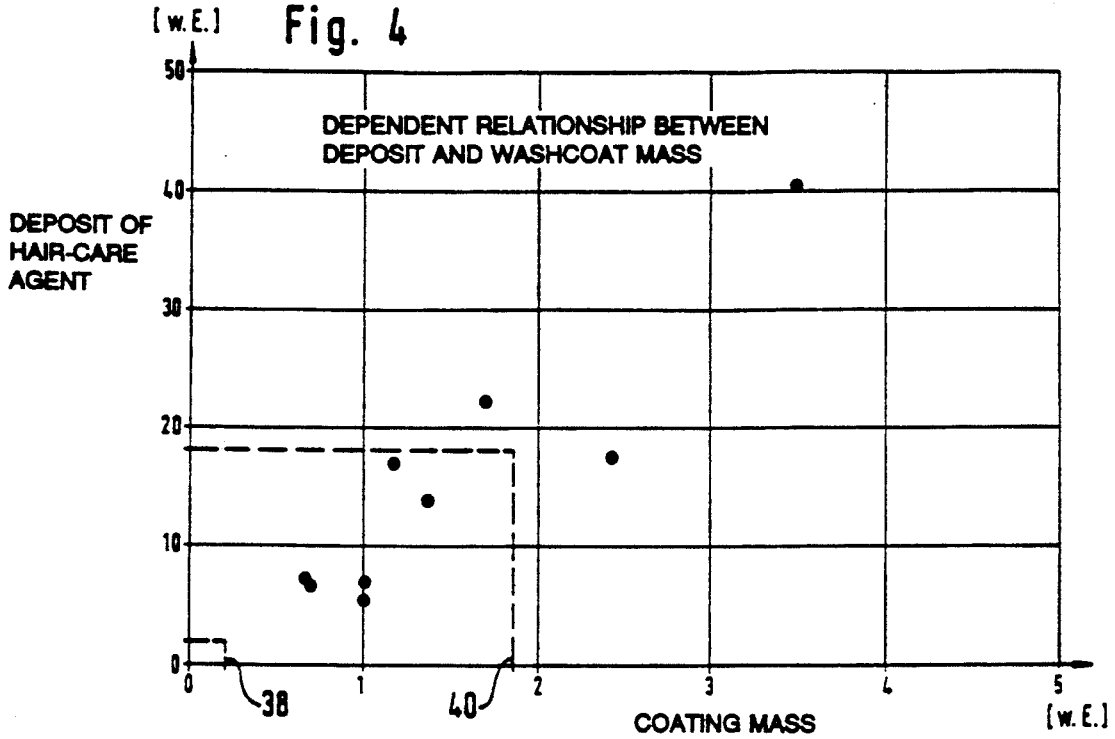
FIG. 4 shows the experimental results to determine the susceptibility to poisoning of the catalyst.

The catalytic device 18 is characterized by its high mechanical stability, its low weight and its excellent activation ability. As FIG. 4 shows, this catalytic device is far superior to the conventional catalyst in terms of susceptibility to poisoning due to hair-care products in particular. In the diagram of FIG. 4, the experimentally established dependent relationship between the mass of the coating 35 (washcoat) and the maximum allowable deposit of hair-care agent on the coating 35 is plotted. The measuring points entered in the diagram indicate how much hair-care agent may deposit on a catalyst provided with the respective coating mass before it is considered unusable due to the effects of poisoning. The measuring results show that the maximum allowable deposit increases with the mass of the ceramic coating applied to the catalyst. However, it will be understood that there are limits to the mass of the coating 35 of the carrier structure 28, because high values will adversely affect the ignitability of the catalyst significantly. For the present embodiment, an optimum is found at values identified by reference numeral 40. If the coating 35 of the carrier structure 28 is set at the values identified by reference numeral 40, an extremely high ignition reliability of the catalytic device 18 is accomplished, and a deposit in amount up to about ten times the maximum deposit on a conventional catalyst is possible without the catalyst becoming inoperable.

The experimental values were obtained using a measuring device according to the following experimental set-up: A hair-care product put in a vessel is placed on a hot plate and evaporated at a temperature of between 140° C. and 160° C., approximately. The vessel is under a bell structure to the upper end of which a curling iron is attached which extends through an opening in the bell structure, such that the air necessary for catalytic combustion is drawn exclusively from the volume present in the bell structure. The bell structure prevents the developing vapors from escaping, directing them only to the active catalyst together with the air supply. To conduct the test, the vessel is filled with about 10 to 15 g of a hair-care product (for example, L'Oreal Studio Line Forming Foam, without CFC), the weight of the hair-care product filled into the vessel being determined by means of a balance. While the test is conducted, the temperature on the curling iron is measured and recorded. When the catalytic reaction ceases, the amount of hair-care product actually evaporated will be determined. If the temperature does not drop, following evaporation of the respective amount of hair-care product filled into the vessel, a heat-up curve is measured with the catalyst on which the deposit of the hair-care product has accumulated, and the activation ability as well as the heat-up time are examined. A catalyst is considered to be a poor catalyst if it fails to be activated after the fifth ignition or if the heat-up time is longer than three minutes.

With a mass of the coating 35 of about 55 mg, the catalyst described in the present embodiment may accumulate a deposit of more than 70 g of hair-care agent without its function being impaired, whereas a conventional catalyst breaks down already when a deposit of about 5 g of hair-care agent (reference numeral 38 in FIG. 4) has accumulated.

Figure 5:
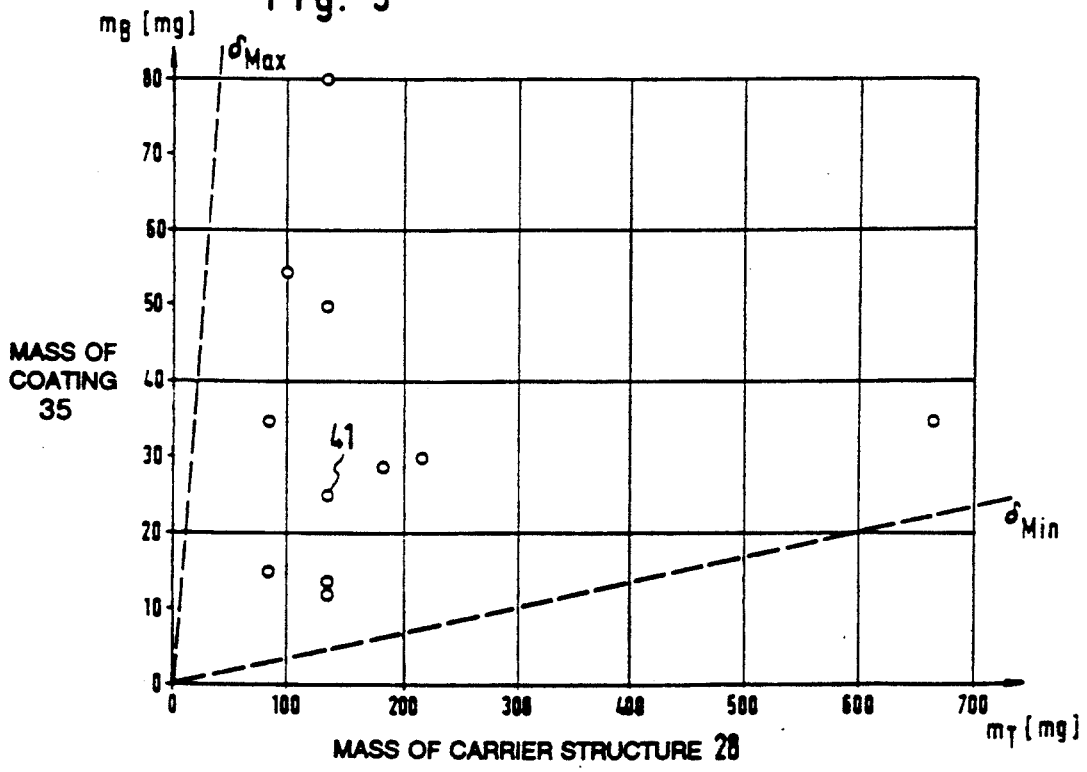
FIG. 5 is a graphical representation of the boundary conditions to be satisfied in the dimensioning of the catalyst.

FIG. 5 in which the mass $m_T$ of the carrier structure 28 is plotted against the mass $m_B$ of the coating 35, related to a single catalyst, shows to what extent these parameters are variable considering all boundary conditions. The straight lines identified by $delta_{Max}$ and $delta_{Min}$ provide an approximate indication of the allowable range of variation of the parameter delta in view of the necessary reduction of the susceptibility to poisoning of the catalyst. Excessive masses of the carrier structure 28 resulting in a reduction of the activation ability or activation quality of the catalyst, they are accordingly unfavorable. On the other hand, insufficient masses of the catalyst carrier structure 28 are unable to ensure the requisite mechanical stability of the catalytic device 18. Within the possible range defined by these limits, the surface area of the coating and the mass of the catalyst carrier structure may be varied while the properties of mechanical stability, activation ability and insusceptibility to poisoning of the catalyst are maintained. The areas marked by circles within this possible range of values having been examined experimentally, it has shown that catalysts configured in this manner satisfy all requirements. The range identified by reference numeral 41 corresponds to the catalyst described in the preferred embodiment.

Of the catalysts examined, the mass of the coating 35 per carrier structure 28 is between 12 mg and 80 mg, with a mass $m_T$ of the carrier structure 28 being from about 70 mg to about 700 mg. The resultant values for delta with $O_B \approx 200$ $m^2/g$ and $s_T$ 7.3 $g/cm^3$) result in a variation range from about $1\times10^6$ to about $2\times10^7$ in which the catalysts have shown to meet all requirements. In determining the individual values, it is to be considered that the mass of the supporting ring 27 fixedly attached to the carrier structure 28 has not been included in the mass $m_T$ of the carrier structure specified above. The supporting ring 27 serves only a mechanical, not a catalytic, function. On account of its thermal coupling to the carrier structure 28—the two parts being connected to each other by mechanical means—, it influences, however, also the activating behavior of the catalyst.

While the present invention has been described in more detail as embodied in a catalytic device installed in a gas-powered curling iron, it is not intended to be limited to these appliances. The invention will also find a useful application in any other type of gas-powered small appliance including, for example, hair dryers, smoothing irons, curler stations, bottle warmers, warming plates, gas cookers, and similar gas-powered appliances for personal use.

We claim:

1. A heatable appliance for personal use, in particular a hair-care appliance, comprising a device for the flameless combustion of a fuel/air mixture and an associated activation device for initiating its flameless combustion, wherein:

(a) said flameless combustion device includes a stable carrier structure of a mass $m_T$ and a density $s_T$;

(b) said carrier structure is provided with a coating having a specific surface area $O_B$ and a mass $m_B$;

(c) said coating carries or contains a catalytically active material of a mass $m_K$; and (d) the ratio $$\text{delta} = \frac{O_B \times m_B}{m_T/s_T} \quad \frac{\text{cm}^2}{\text{cm}^3}$$

assumes values in the range of $$0.3\times10^6 \lesssim \text{delta} \lesssim 30\times10^6.$$

2. The appliance as claimed in claim 1, wherein said carrier structure is comprised of a perforated metal foil, in particular a stainless-steel foil or, alternatively, a wire lattice, with a thickness d smaller than or approximately equal to 100 micrometers, in particular 25 micrometers $\lesssim d \lesssim$ 50 micrometers, are preferably about 35 micrometers.

3. The appliance as claimed in claim 2, wherein the percentage of said perforations, related to the total area of said carrier structure is in the range of between 5% and 60%, preferably between 15% and 50%.

4. The appliance as claimed in one of claims 1-3, wherein said coating is made of a ceramic material, in particular metastable alumina, and has a specific surface area $O_B > 100$ $m^2/g$, in particular $O_B \approx 200$ $m^2/g+/-30\%$.

5. The appliance as claimed in one of claims 1-3 wherein said catalytically active material is comprised of one of the elements Pt, Pd, and Rh and that the ratio $M_{KB}=m_K/m_B$ is smaller than, or approximately equal to 0.2, preferably $M_{KB} \lesssim 0.13$.

6. The appliance as claimed in claim 1, wherein said activation device ignites a fuel/air mixture of a volume $V_G$, and the overall mass $m_G=m_T+m_B+m_K$, related to the volume $V_G$, assumes the following values:

$$m_G/V_G \lesssim 0.1 \text{ g/cm}^3, \text{ preferably}$$

$$m_G/V_G \lesssim 0.01 \text{ g/cm}^3.$$

7. The appliance as claimed in any one of 1, 2, 3, or 6 wherein the ratio $M_{BT}=m_B/m_T$ assumes values in the following range:

$$0.02 \lesssim M_{BT} \lesssim 0.60, \text{ preferably } M_{BT} \approx 0.20+/-50\%.$$

8. The appliance as claimed in claim 1 or 6 wherein in the use of a stainless-steel foil of an approximate thickness d of between 30 and 50 micrometers as the carrier structure and metastable alumina with a specific surface area $O_B \approx 200$ $m^2/g+/-30\%$ as the coating (35), delta assumes a preferred value in the following range:

$$\text{delta} \approx 2.8\times10^6+/-50\%.$$

9. The appliance as claimed in claim 1 or 6 wherein at least 2.5% of the area of said carrier structure are arranged normal to a direction of propagation of a flame front produced by said activation device.

10. The appliance as claimed in claim 1 or 6 wherein a distributor made of screen fabric with a mesh size in the range of between 50 micrometers and 500 micrometers, particularly 180 micrometers, is arranged upstream of said device, when viewed in the direction of flow.

11. A heatable appliance for personal use, in particular a hair-care appliance, including a device for the flameless combustion of a fuel/air mixture and an associated activation device for initiating its flameless combustion characterized by the following features:

(a) said device is comprised of a perforated stainless-steel foil of a thickness of between 25 micrometers and 50 micrometers;

(b) the percentage of said perforations, related to the total area of said stainless-steel foil, is between 15% and 50%;

(c) said stainless-steel foil is provided with a ceramic coating having a specific surface area of between 140 $m^2/g$ and 260 $M^2g$; and (d) the masses $m_B$ and $m_T$ of the coating and, respectively, the carrier foil having the following ratio:

$$m_B/m_T \approx 0.2+/-50\%.$$

12. The appliance as claimed in claim 11, characterized in that said coating serves as the carrier of platinum of a mass $m_K$, with the ratio of said masses $m_K/m_B$ being as follows:

$$m_K/m_B \approx 0.1+/-50\%.$$

13. The appliance as claimed in either claim 11 or 12 wherein said stainless-steel foil is a hollow cylinder closed at one end and having a height h of 3 cm+/−1 cm and a mean diameter d of 1 cm+/−0.5 cm.

14. The appliance as claimed in claim 1, 6 or 11, characterized by its use as a gas-powered curling iron, hair dryer, smoothing iron, curler station, bottle warmer, gas cooker, warming plate.

15. A method for constructing a device for flameless combustion of a fuel/air mixture in a heatable appliance for personal use, in particular a hair-care appliance, said method comprising:

providing a stable carrier structure of a mass $m_T$ and a density $s_T$;

forming a coating on said stable carrier, said coating having a specific surface area $O_B$ and a mass $m_B$;

incorporating a catalytically active material of a mass $m_K$ into or on said coating; and selecting $m_T$, $s_T$, $O_B$, and $m_B$ so that the ratio $$\text{delta} = \frac{O_B \times m_B}{m_T/s_T} \quad \frac{\text{cm}^2}{\text{cm}^3}.$$

assumes values in the range of $$0.3\times10^6 \lesssim \text{delta} \lesssim 30\times10^6.$$

* * * * *